US005101676A

United States Patent [19]

Collins

[11] Patent Number: 5,101,676

[45] Date of Patent: Apr. 7, 1992

[54] ATTACHMENT FOR SUCKER ROD DEPTH ADJUSTMENT

[76] Inventor: Norman D. Collins, P.O. Box 721, 514 E. Rio Grande, Pearsall, Tex. 78061

[21] Appl. No.: 680,521

[22] Filed: Apr. 4, 1991

[51] Int. Cl.[5] ..... F16H 21/32

[52] U.S. Cl. ..... 74/41; 166/68.5

[58] Field of Search ..... 74/41; 166/68.5; 160/85

[56] References Cited

U.S. PATENT DOCUMENTS

| | | | |
|---|---|---|---|
| 227,887 | 5/1880 | Edelen | 74/41 |
| 3,051,237 | 8/1962 | Liles, Jr. et al. . | |
| 3,606,797 | 9/1971 | Browning | 74/41 X |
| 3,782,123 | 1/1974 | Muschalek, Jr. | 74/41 X |
| 4,286,656 | 9/1981 | Felder | 166/75 |
| 4,296,678 | 10/1981 | Felder | 92/13.1 |
| 4,346,620 | 8/1982 | Stanton | 74/41 X |
| 4,354,395 | 10/1982 | Page, Jr. | 74/41 |
| 4,354,397 | 10/1982 | Fix | 74/41 X |

FOREIGN PATENT DOCUMENTS

| | | | |
|---|---|---|---|
| 82/00859 | 3/1982 | World Int. Prop. O. | 166/68.5 |

*Primary Examiner*—Dwight Diehl
*Attorney, Agent, or Firm*—John F. Bryan, Jr.

[57] ABSTRACT

A sucker rod depth adjusting attachment for conventional oil well surface units for operating down-hole pumps includes a cross bar which rests atop the existing carrier bar and supports a matching adjusting bar by means of interconnecting, adjustable length rams. The ram locations are off-center of the well center and sucker rod depth is varied by adjusting the ram length. In an alternate embodiment, the carrier bar and cross bar are combined as a single part.

14 Claims, 5 Drawing Sheets

ATTACHMENT FOR SUCKER ROD DEPTH ADJUSTMENT

TECHNICAL FIELD OF THE INVENTION

The present invention relates to an attachment for adjusting the effective sucker rod length of surface oil well pumping units having a walking beam, a suspended carrier beam and an interconnected sucker rod assembly for stroking a reciprocating down-hole pump.

BACKGROUND AND SUMMARY OF THE INVENTION

Surface pumping units for drawing down-hole fluids from wells are well known in the oil field. Such units operate a reciprocating pump which is located down-hole, at or below the fluid level. A counterweighted walking beam arrangement is mounted on a base and driven to move up and down through a limited arc. Flexible wirelines work along the face of an arcuate horsehead at the end of the walking beam to impart a straight, vertical reciprocating stroke to a carrier bar, and in turn to a sucker rod assembly. This assembly includes a round polished rod at the upper end, which enters the well through a well head packing gland. The sucker rod then extends deep into the well to drive a down-hole pump.

The well may be 10,000' deep or more, causing this length of sucker rod to stretch under the load of its weight of over 20,000 pounds. The amount of stretch is not entirely predictable, and a new installation will usually require several attempts to find the proper sucker rod depth adjustment. The sucker rod also tends to stretch under operating loads over long periods, so that a compensating adjustment is needed from time to time. Another consideration is that the required adjustment range increases with well depth.

In some areas there are potential pumping porblems because of down hole gas build-ups. Although it is cumbersome with conventional equipment, many operators periodically adjust the sucker rod depth to bump the bottom of the hole so as to shake any gas bubbles loose.

This is done by stopping the pump near bottom of its stroke and tightening a temporary friction clamp on the polished rod where it will rest on the well head to support the string. The primary clamp, seated atop the carrier bar, is then loosened and respositioned higher on the polished rod. The pump drive is then rotated to bring the carrier bar up against the repositioned clamp, picking up the weight of the sucker rod string and allowing removal of the temporary clamp. Hopefully, the respositioned clamp is properly located and the desired results are achieved without a second try. A reverse procedure is then followed to restore the pump to normal operation. It must be appreciated that working with such massive loads is done carefully, but even so, is always accompanied by the risk of material or personal injury.

There have been efforts to address this task with greater facility, not only for economy of labor cost, but to promote safety with the frequently less experienced help currently available, and to avoid damage to expensive equipment and lost production. Notably Felder, in his U.S Pat. Nos. 4,286,656 and 4,296,678, discloses a hollow hydraulic ram which receives the polished rod for use as a sucker rod jack, and teaches a method of multiple operations for making adjustments greater than the stroke length of the ram.

In actual practice, an adjustment range of 24" or more is useful, and since an inherent need for doing multiple step adjustments would be self defeating, the use of 24" or longer stroke rams is indicated. The collapsed length dimension of a 24" stroke ram is approximately 30", making the extended length about 54". Working clearance at the well center of a typical installation is frequently insufficient for such dimnension, so that there would be interference with either the horsehead above, or the well head below.

The use of such carrier bar devices, prior to the present invention, has also entailed replacement of the carrier bar, and very possibly the connecting wirelines. Since carrier bars are not universally interchangable, with different wireline spacing and connections, a variety of modifications and adaptations have been needed. Also, the hollow piston rams of such prior devices must have at least two seal diameters and, as compared to conventional solid piston rams, are expensive to replace, prone to leakage and difficult to repair.

A first object of the present invention therefore is to provide a sucker rod depth adjusting attachment which avoids interference with pump and well components above and below the carrier beam, and to provide the attachment in configurations suitable to operators and to original equipment pumping unit manufacturers.

A second object of the present invention is to provide a sucker rod depth adjusting attachment which is capable of installation on conventional surface pumping units of various manufacturers and models without replacement or modification of the existing parts.

A third object of the present invention is to provide a sucker rod depth adjusting attachment which minimizes the need for maintenance and furthermore is readily repaired if such need arises.

The present invention accomplishes these objectives in an economical manner, with an attachment that rests atop any conventional, unmodified carrier bar while requiring minimal excess vertical clearance. A cross bar lies transversely across the carrier bar, supporting underslung solid piston rams on each side thereof. The upper piston ends of these rams abut a depth adjusting bar, which matches the general shape of the cross bar and is adjustably positioned above the cross bar by extension or retraction of the rams. Centrally located rod holes in both of the attachment bars align with a similar hole in the carrier bar so that the polished rod can be clamped above the depth adjusting bar as it formerly was above the carrier bar. In this manner, the maximum clearance height requirement is limited to no more than the stroke of the rams, plus the thickness of the attachment bars, or about 30", and this together with the underslung placement of the rams, away from the well center, avoids vertical interference.

DESCRIPTION OF THE DRAWINGS

The aforementioned, and other objects and features of the invention will be apparent from the following detailed description of specific embodiments thereof, when read in conjunction with the accompanying drawings, in which.

DETAILED DESCRIPTION OF THE INVENTION

Figure 1:
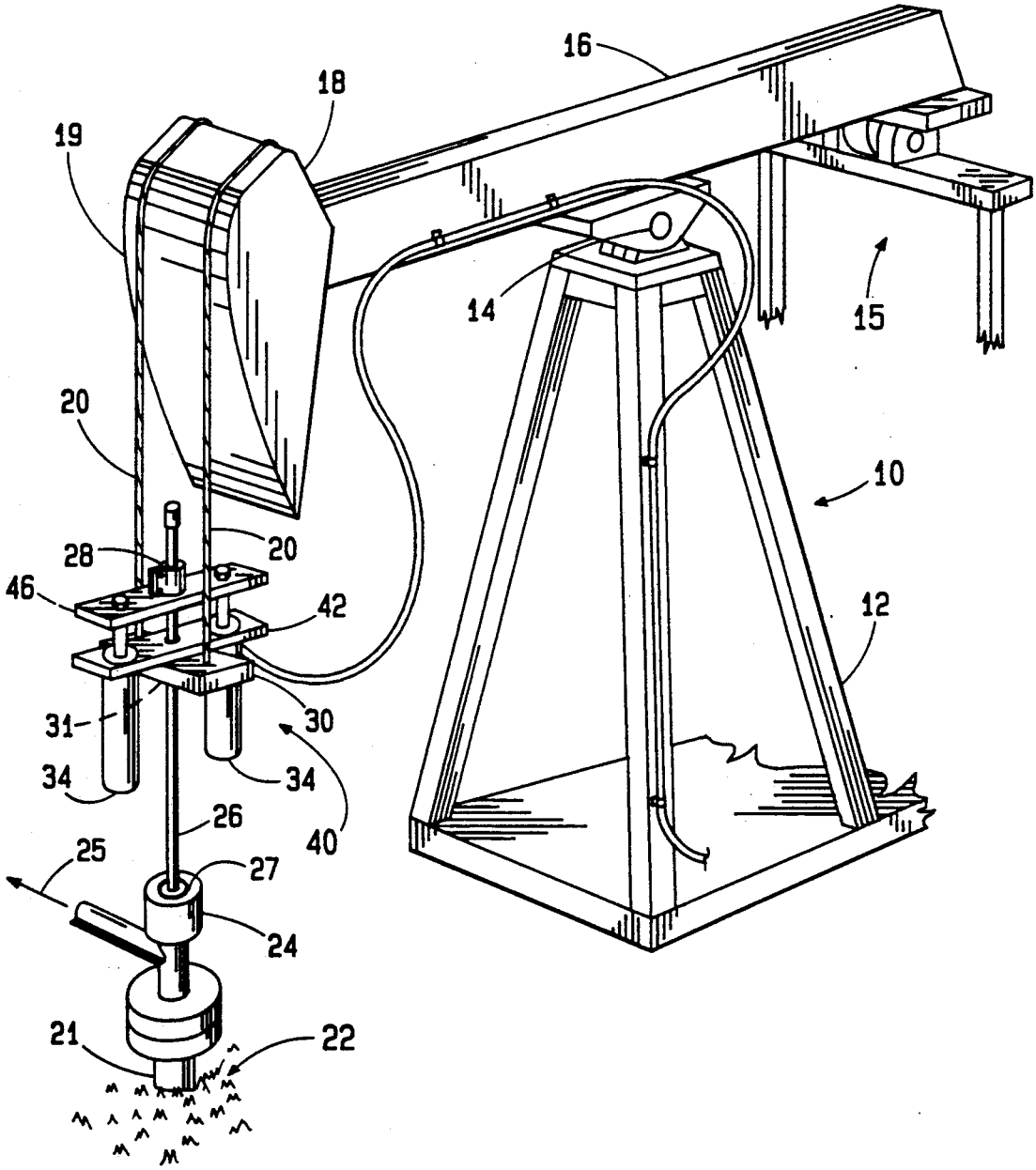
FIG. 1. shows an overall view of a first preferred embodiment of the present invention as installed on a pumping unit.
Figure 2:
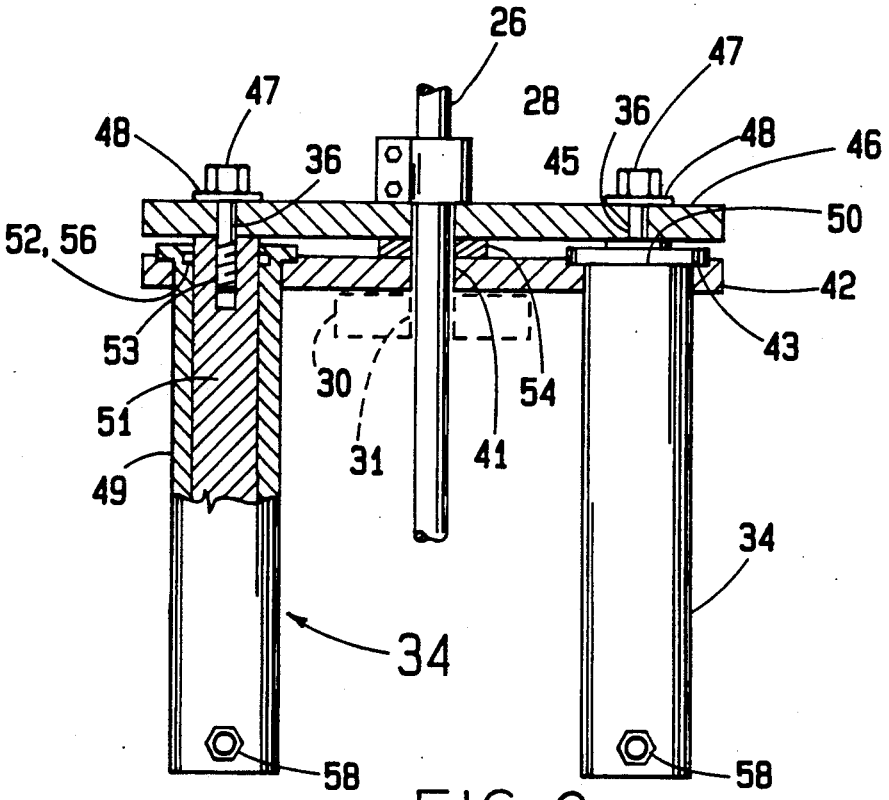
FIG. 2. shows a detail view of the first preferred embodiment.

Referring now to the drawings, wherein FIG. 1, shows a conventional pumping unit 10, comprising samson post 12 with center bearing 14, which mounts walking beam 16 for pivotal movement, and to FIG. 2 for a more detailed view of a preferred embodiment 40, of the present invention. Walking beam 16 is driven to move in an oscillating manner by counterweighted drive 15, which is well known to the art nd need not be fully shown. Horsehead 18 moves up and down in an scillating manner, imparting this motion to the wirelines assemblies 20—20 attached adjacent each end of carrier bar 30. The arcuate face 19 of horsehead 18 holds wirelines 20—20 in the plane of well 21, so that carrier bar 30 moves in straight line reciprocating motion over well head 24. The present invention, as shown in the preferred embodiment 40, is supported by conventional carrier bar 30. Cross bar 42 rests transversely upon carrier bar 30 so that cross bar center hole 41 is in alignment with carrier bar center hole 31. Rams 34—34 are mounted on cross bar 42 on both sides of carrier bar 30 in an underslung fashion, and in turn support adjusting bar 46. In this manner the rams 34—34 straddle well 21, which is capped above ground level 22 by well head 24. Polished rod 26 passes through carrier bar center hole 31 to enter well head 24 through packing gland 27 and connects to a sucker rod string as is well known in the art and thus need not be shown. Polished rod friction clamp 28, seated on adjusting bar 46, supports polished rod 26 so that it is stroked vertically to operate a conventional reciprocating down-hole pump by means of the interconnected sucker rod string, thereby generating well production flow 25.

Figure 3:
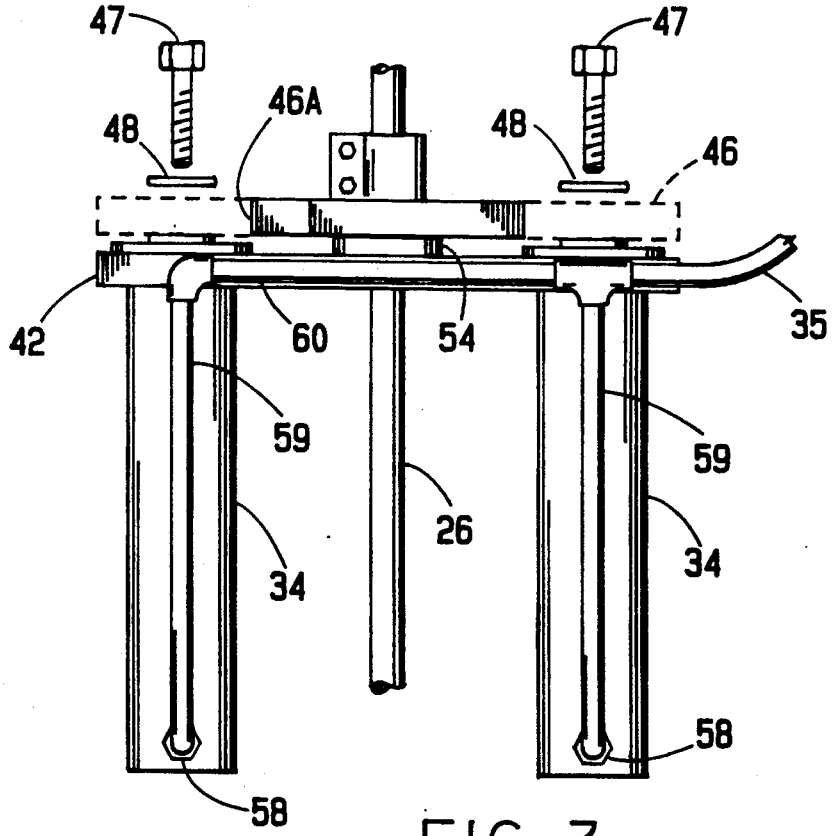
FIG. 3. shows the first preferred embodiment as arranged for in-place ram replacement or repair.

FIG. 2 provides a detailed view of the preferred embodiment 40, in which polished rod 26 is shown to pass through center hole 31 of carrier bar 30, cross bar center hole 41, spacing washer 54, and adjusting bar center hole 45, to be supported by friction clamp 28. Each ram 34 comprises a cylindrical body 49, a piston 51 and a seal 52. The cylindrical bodies 49—49 have mounting flanges 50—50 which support rams 34—34 on counterbored shoulders 43—43 of cross bar 42. The piston rods 51—51 are sized for a close working fit in cylindrical bodies 49—49 so that the overall length of rams 34—34 can be adjusted hydraulically. Seal 52 is carried in seal groove 56 to prevent leakage of the grease or chosen hydraulic medium and maintain the adjusted length under working conditions. Each piston rod 51 abuts the lower surface of adjusting bar 46 where it is held in place by attaching bolt 47 passing through mounting hole 36 of adjusting bar 46 to thread into tapped hole 53 of piston 51. Locking washers 48—48 keep attaching bolts 47—47 from loosening. Spacing washer 54 is seen to be located between cross bar 42 and adjusting bar 46 so as to take the load of polished rod 26 when pistons 51—51 are fully retracted. FIG. 3 shows the manifolding of the preferred embodiment 40, and specifically how fluid connections 58—58 are interconnected through cylinder tubes 59—59 and cross tube 60 to grease line 35. This arrangement allows grease or hydraulic fluid to be added or taken from rams 34—34 equally, so that adjusting bar 46 remains parallel to cross bar 42 at all times. Repair or replacement of a ram 34 entails venting the system through grease line 35 so as to fully retract pistons 51—51. This transfers the load to spacing washer 54 which, upon removal of attaching bolts 47—47, acts as a thrust bearing so that adjusting bar 46 can be rotated to the 46A position, allowing access to to rams 34—34. In this position, pistons 51—51 may be withdrawn to replace a worn seal 52, or rams 34—34 may be replaced, with minimal disassembly and lost time.

Figure 4A:
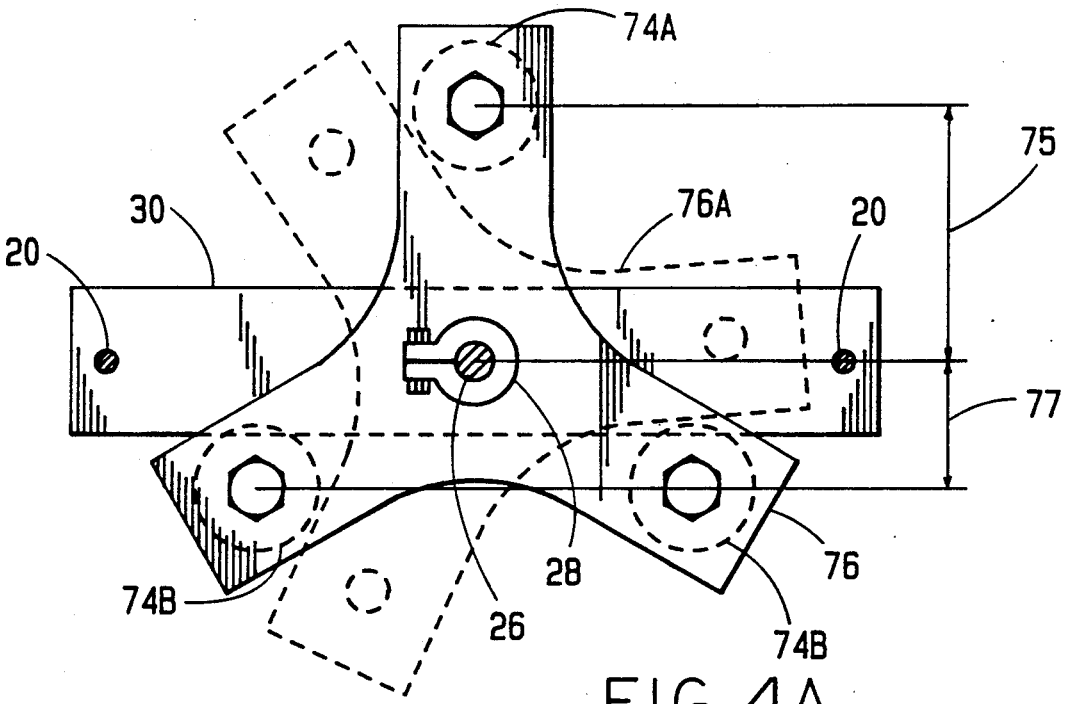
FIG. 4A. shows a plan view of the second preferred embodiment.
Figure 4:
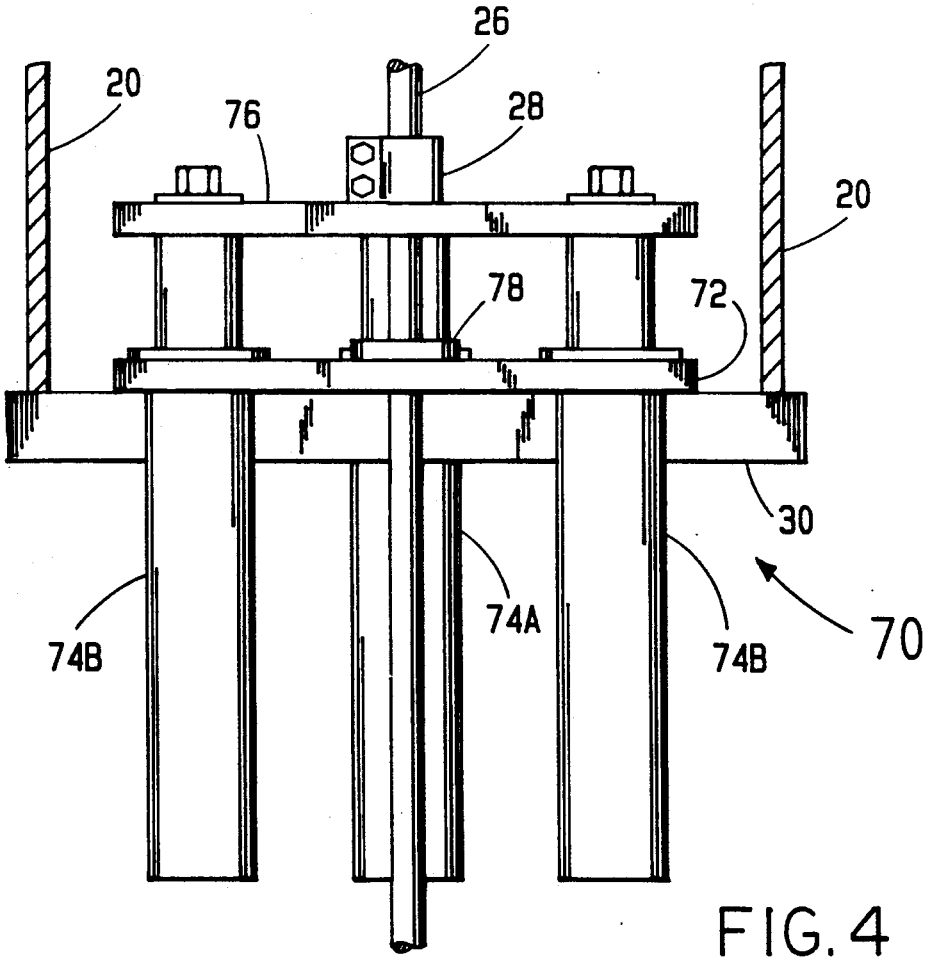
FIG. 4. shows an elevation view of a second preferred embodiment.

In FIGS. 4 and 4A is shown an alternate embodiment 70 as if installed on carrier bar 30. Three equally spaced rams 74 are mounted on cross bar 72 to support depth adjusting bar 76. The single rear ram 74A has a working moment arm 75 which is twice the moment arm 77 of the two forward rams 74B—74B so that the adjusting bar 76 is supported in a balanced manner parallel to cross bar 72. The repair method of the preferred embodiment 40 works as readily in this case, by turning the adjustment bar 76 to position 76A with spacer washer 78 acting as a thrust bearing, and proceding in the manner previously described.

Figure 5A:
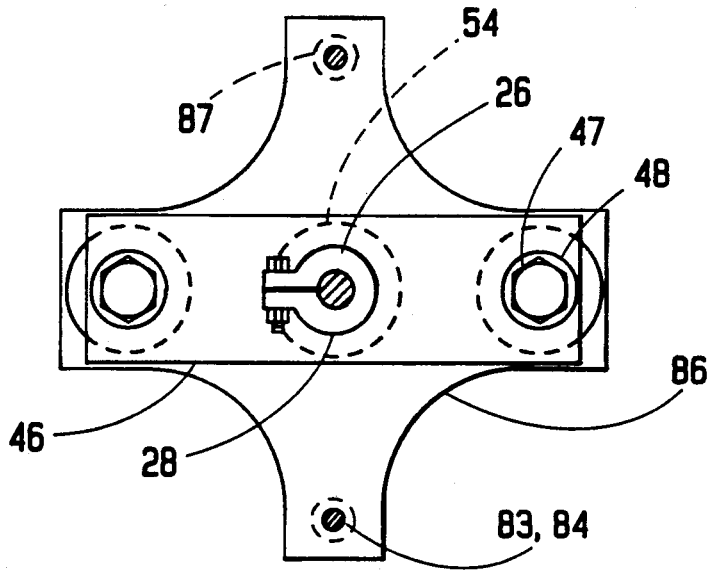
FIG. 5A. shows a plan view of the embodiment of FIG. 5.
Figure 5:
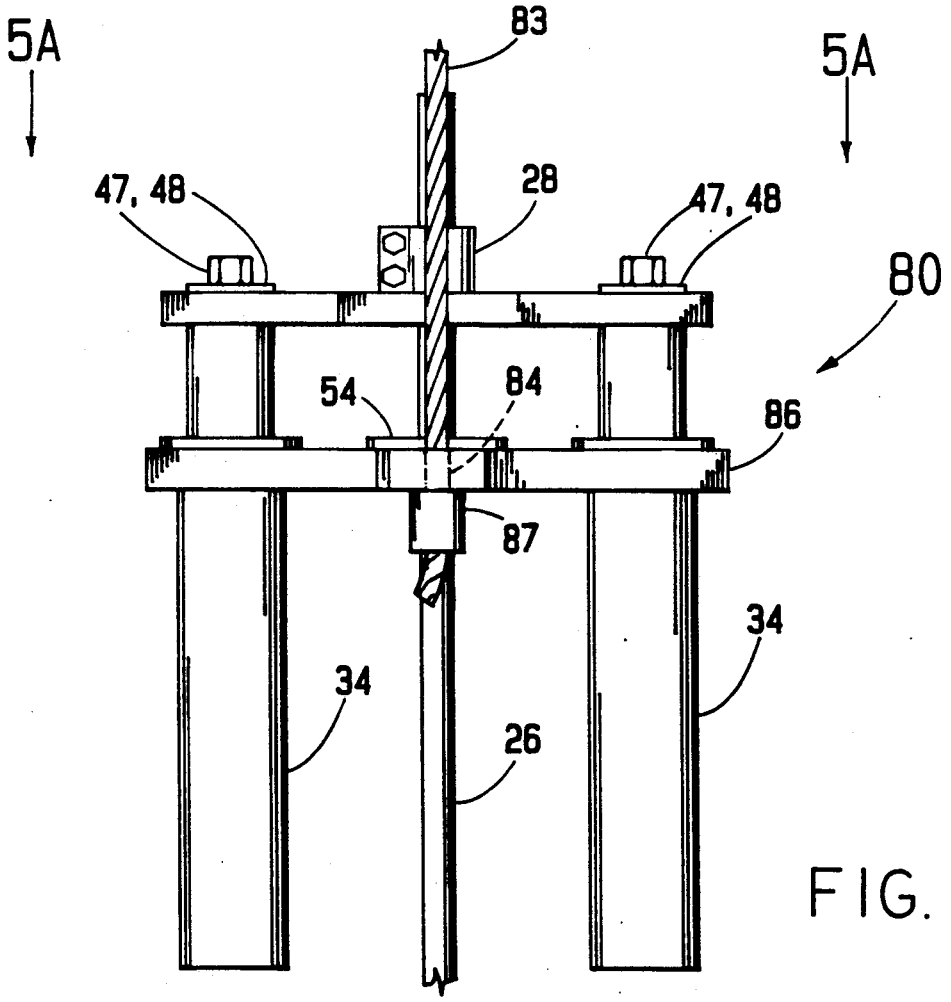
FIG. 5 shows an elevation view of a third preferred embodiment of the present invention as instaled as original equipment.

In FIGS. 5 and 5A the invention is shown in yet another embodiment as "hydraulic carrier" 80, for supply by original manufacturers of pumping units. In this case, carrier plate 86, of cruciform shape replaces the carrier bar 30 and the cross bar 42 of first preferred embodiment 40 by combining their functions. Wire lines 83 pass through carrier connections 84 to be clamped by swaged collars 87 and thereby support the weight of the loaded assembly 80. In all ways, assembly 80 functions as embodiment 40, using identical rams 34, adjusting bar 46, spacing washer 54 and the attaching bolts 47 and lock washers 48. FIG. 5A, taken from the direction of arrows 5A—5A of FIG. 5 shows the cruciform shape of carrier plate 86.

Figure 6:
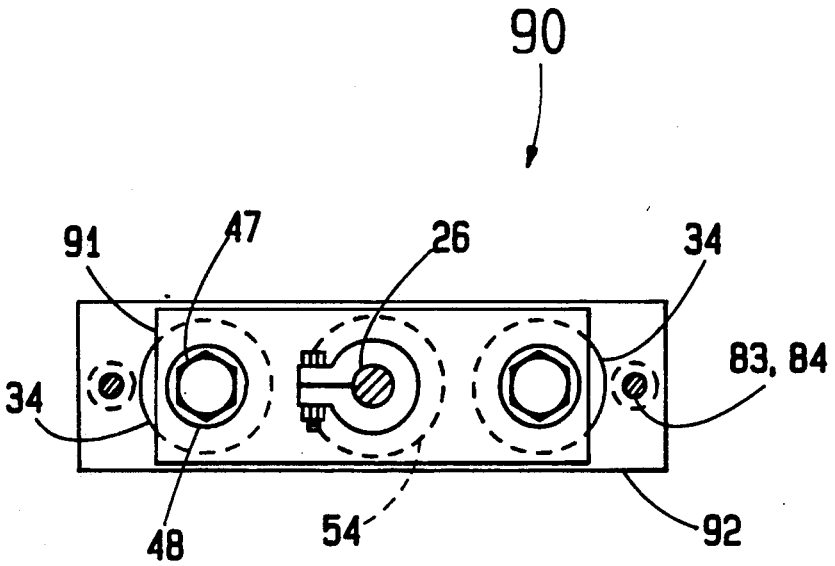
FIG. 6 shows an alternate ram arrangement for the third preferred embodiment.
Figure 7:
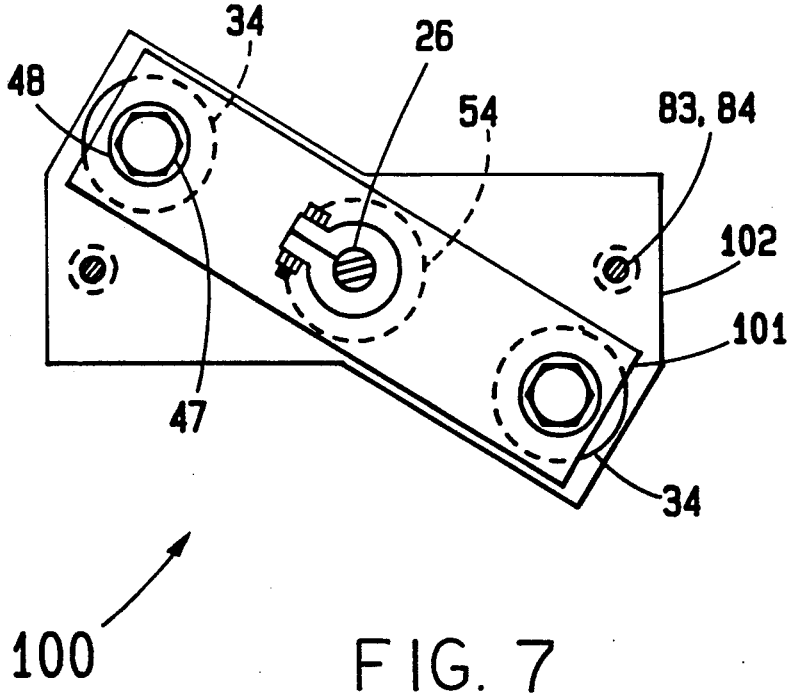
FIG. 7. shows a second alternate ram arrangement for the third preferred embodiment.

FIGS. 6 and 7 show alternative embodiments 90 and 100, differing from hydraulic carrier 80 only in placement of rams 34 on altered carrier plates 92 and 102 respectively, with their adjusting bars 91 and 101. This illustrates that it is necessary only to balance the loads supported by rams 34 and avoid interference with wire lines 83.

From the foregoing, it is clear that multiple rams in various sizes and combinations may be positioned for functionally equivalent embodiments of the present invention. It is to be understood that the invention is not limited to the disclosed embodiments, but can be expressed in equivalent form, such as by inversion of the hydraulic rams or by modification or substitution of parts or elements without departing from the spirit of the invention.

I claim:

1. In a surface unit of an oil well pumping system, having a walking beam, a suspended carrier bar and an interconnected sucker rod assembly for stroking a reciprocating down-hole pump, an attachment for adjusting the effective sucker rod depth comprising:

a cross bar having a centrally located passage therein for said sucker rod assembly and adapted to be transversely supported by said carrier bar;

a depth adjusting bar, having a centrally located passage therein for said sucker rod assembly, positioned at a selected fixed dimension above and parallel to said cross bar and adapted to operatively support said sucker rod assembly;

clamping means for fixing said sucker rod relative to said depth adjusting bar; and hydraulically extendable means supportively connecting said depth adjusting bar to said cross bar on at least each side of said carrier bar for adjusting said selected fixed dimension and maintaining said adjustment during operation.

2. An attachment for adjusting the effective sucker rod depth of an oil well pumping system in accordance with claim 1 wherein said hydraulically extendable means further comprises:

two or more hydraulic actuator assemblies, each having a cylindrical portion and a piston portion, sealed for hydraulically adjusted positioning within said cylindrical portion, so as to adjust the overall length of said hydraulic actuator;

connecting means for connecting said portions to said cross bar and to said depth adjusting bar; and manifold means for uniform hydraulic positioning of said piston portions so as to adjust said selected fixed dimension.

3. An attachment for adjusting the effective sucker rod depth of an oil well pumping system in accordance with claim 1 wherein said clamping means comprises a friction clamp tightened on said sucker rod assembly and directly supported by said depth adjusting bar.

4. An attachment for adjusting the effective sucker rod depth of and oil well pumping system in accordance with claim 2 wherein said cylindrical portion further comprises:

a closed end adapted for connection to said manifold means;

an open end adapted for sealed entry and relative movement of said piston portion; and connecting means adjacent said open end for connecting said cylindrical portion to said cross bar.

5. An attachment for adjusting the effective sucker rod depth of an oil well pumping system in accordance with claim 4 wherein said clamping means comprises a friction clamp tightened on said sucker rod assembly and directly supported by said depth adjusting bar.

6. In a surface unit of an oil well pumping system, having a walking beam, a suspended carrier bar and an interconnected sucker rod assembly for stroking a reciprocating down-hole pump, an attachment for adjusting the effective sucker rod depth comprising:

a cross bar, having two ends and a centrally located passage therein for said sucker rod assembly, and adapted to be transversely supported atop said carrier bar without alteration thereof;

a depth adjusting bar, having two ends and a centrally located passage therein for said sucker rod assembly, positioned at a selected fixed dimension above and parallel to said cross bar and adapted to operatively support said sucker rod assembly;

a hydraulic ram, having a cylindrical body and a hydraulically positioned piston for adjusting the overall length thereof, mounted at each end of said cross bar and supporting said depth adjusting bar at each end thereof to maintain said selected fixed dimension during operation of said pumping system;

manifold means for hydraulically moving and positioning said pistons uniformly as to adjust said selected fixed dimension; and a clamp applied to said sucker rod assembly and supporting said sucker rod relative to said depth adjusting bar so as to determine the operating depth of said sucker rod.

7. An attachment for adjusting the effective sucker rod depth of an oil well pumping system in accordance with claim 6 wherein said ram cylindrical body further comprises:

a closed end adapted for connection to said manifold means;

an open end adatped for sealed entry and relative movement of said hydraulically positioned piston; and flanged means adjacent said open end for mounting said ram on said cross bar.

8. In a surface unit of an oil well pumping system, having a walking beam, a suspended carrier bar and an interconnected sucker rod assembly for stroking a reciprocating down-hole pump, an attachment for adjusting the effective sucker rod depth comprising:

a cross bar, having a centrally located passage therein for said sucker rod assembly, and adapted to be transversly supported atop said carrier bar without alteration thereof;

a depth adjusting bar, having a centrally located passage therein for said sucker rod assembly, positioned at a selected fixed dimension above and parallel to said cross bar and adapted to operatively support said sucker rod assembly;

a plurality of hydraulic rams, each having a cylindrical body and a hydraulically positioned piston for adjusting the overall length thereof, mounted to said cross bar at each side of said carrier in balanced locations to parallelly support said depth adjusting bar and maintain said selected fixed dimension during operation of said pumping system;

manifold means for hydraulically moving and positioning said pistons uniformly as to adjust said selected fixed dimension; and a clamp applied to said sucker rod assembly and supporting said sucker rod relative to said depth adjusting bar so as to determine the operating depth of said sucker rod.

9. An attachment for adjusting the effective sucker rod depth of an oil well pumping system in accordance with claim 8 wherein said ram cylindrical body further comprise:

a closed end adapted for connection to said manifold means;

an open end adapted for sealed entry and relative movement of said hydraulically positioned piston; and flanged means adjacent said open end for mounting said ram on said cross bar.

10. A surface unit for an oil well pumping system having a walking beam and spaced apart wire lines that suspend carrier means for stroking a reciprocating down-hole pump with a sucker rod assembly, wherein said carrier means comprises:

a carrier plate adapted to be suspended by said spaced apart wire lines and having a passage therein for said sucker rod assembly located between said wirelines in the common plane thereof;

a depth adjusting bar, having a centrally located passage therein for said sucker rod assembly, positioned at a selected fixed dimension above and parallel to said carrier plate, so as to not interfere with said wire lines, and adapted to operatively support said sucker rod assembly:

clamping means for fixing said sucker rod relative to said depth adjusting bar; and hydraulically extendable means supportively connecting said depth adjusting bar parallel to said carrier plate at two or more spaced apart locations not interfering with said wire lines, for adjusting said selected fixed dimension and maintaining said adjustment during operation of said unit.

11. Carrier means for an oil well pumping system in accordance with claim 10 wherein said hydraulically extendable means further comprises:

two or more hydraulic actuator assemblies, each having a cylindrical portion and a pistion portion, sealed for hydraulically adjusted positioning within said cylindrical portion, so as to adjust the overall length of said hydraulic actuator;

connecting means for connecting said portions to said carrier plate and to said depth adjusting bar; and manifold means for uniform hydraulic positioning of said piston portions so as to adjust said selected fixed dimension.

12. Carrier means for an oil well pumping system in accordance with claim 10 wherein said clamping means comprises a friction clamp tightened on said sucker rod assembly and directly supported by said depth adjusting bar.

13. Carrier means for an oil well pumping system in accordance with claim 11 wherein said hydraulically extendable means further comprises:

a closed end adapted for connection to said manifold means;

an open end adapted for sealed entry and relative movement of said piston portion; and connecting means adjacent said open end for connecting said cylindrical portion to said carrier plate.

14. Carrier means for adjusting the effective sucker rod depth of an oil well pumping system in accordance with claim 13 wherein said clamping means comprises a friction clamp tightened on said sucker rod assembly and directly supported by said depth adjusting bar.

* * * * *